US007566247B2

(12) United States Patent
Rothermel et al.

(10) Patent No.: US 7,566,247 B2
(45) Date of Patent: Jul. 28, 2009

(54) SKEW CONTROLLED LEADFRAME FOR A CONTACT MODULE ASSEMBLY

(75) Inventors: Brent Ryan Rothermel, Harrisburg, PA (US); Alex Michael Sharf, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 149 days.

(21) Appl. No.: 11/821,809

(22) Filed: Jun. 25, 2007

(65) Prior Publication Data

US 2008/0316729 A1 Dec. 25, 2008

(51) Int. Cl.
*H01R 13/648* (2006.01)

(52) U.S. Cl. ..... 439/608; 439/108

(58) Field of Classification Search ..... 439/608, 439/108, 101, 79

See application file for complete search history.

(56) References Cited

U.S. PATENT DOCUMENTS

| | | | | |
|---|---|---|---|---|
| 4,290,661 | A | 9/1981 | Burns | |
| 4,488,768 | A | 12/1984 | Sigmon | |
| 5,496,183 | A | 3/1996 | Soes et al. | |
| 6,652,319 | B1 | 11/2003 | Billman | |
| 6,955,565 | B2 | 10/2005 | Lloyd et al. | |
| 7,131,870 | B2 | 11/2006 | Whiteman, Jr. et al. | |
| 7,172,461 | B2 | 2/2007 | Davis et al. | |
| 7,175,446 | B2 * | 2/2007 | Bright et al. | 439/79 |
| 7,331,802 | B2 * | 2/2008 | Rothermel et al. | 439/108 |
| 2006/0216969 | A1 * | 9/2006 | Bright et al. | 439/79 |
| 2007/0099455 | A1 * | 5/2007 | Rothermel et al. | 439/108 |
| 2008/0102702 | A1 * | 5/2008 | Sercu et al. | 439/608 |
| 2008/0176453 | A1 * | 7/2008 | Minich et al. | 439/660 |

FOREIGN PATENT DOCUMENTS

| | | | |
|---|---|---|---|
| EP | 1 732 176 | A1 | 12/2006 |
| WO | WO 2006/029670 | A1 | 3/2006 |

OTHER PUBLICATIONS

International Search Report, International Application No. PCT/US2008/007641, International Filing Date Jun. 19, 2008.

* cited by examiner

*Primary Examiner*—Gary F. Paumen

(57) ABSTRACT

A leadframe for a contact module assembly includes a terminal set having first, second and third terminals configured to operate in one of a signal-signal-ground pattern and a ground-signal-signal pattern. Each of the terminals have a length that extends between a mating end and a mounting end, wherein a difference in lengths between the first terminal and the second terminal is the same as a difference in lengths between the second terminal and the third terminal such that the terminal set has the same amount of skew between the terminals defining signal contacts in both the signal-signal-ground pattern and the ground-signal-signal pattern.

20 Claims, 8 Drawing Sheets

SKEW CONTROLLED LEADFRAME FOR A CONTACT MODULE ASSEMBLY

BACKGROUND OF THE INVENTION

This invention relates generally to contact module assemblies, and more particularly, to reduced skew leadframes for contact module assemblies.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput.

In a traditional approach for interconnecting circuit boards, one circuit board serves as a back plane and the other as a daughter board. The back plane typically has a connector, commonly referred to as a header, which includes a plurality of signal contacts which connect to conductive traces on the back plane. The daughter board connector, commonly referred to as a receptacle, also includes a plurality of contacts. Typically, the receptacle is a right angle connector that interconnects the back plane with the daughter board so that signals can be routed therebetween. The right angle connector typically includes a mating face that receives the plurality of signal pins from the header on the back plane, and contacts on a mounting face that connect to the daughter board.

At least some right angle connectors include a plurality of contact modules that are received in a housing. The contact modules typically include a leadframe encased in a dielectric body. The leadframe includes a plurality of terminals that interconnect electrical contacts held on a mating edge of the contact module with corresponding contacts held on a mounting edge of the contact module. Different contact modules of the same connector sometimes have different patterns, sometimes referred to as wiring patterns, of the terminals and/or the mating and mounting edge contacts. For example, adjacent contact modules within the housing may have different patterns of signal, power, and/or ground terminals and/or contacts to enhance the electrical performance of the connector by reducing crosstalk between the adjacent contact modules. However, different leadframes must be designed and manufactured for each of the contact modules having different terminal and/or contact patterns, which may increase the difficulty and/or cost of manufacturing the connector.

Another problem associated with known right angle contact modules is that the terminals have different lengths between the corresponding contacts. The different lengths of the terminals, particularly with respect to terminals carrying differential signals, provide two different path lengths for the signals. When the differential signals are transmitted along different path lengths, the signal is degraded, also referred to as skew. Signal skew results from a difference in the time that a pair of identical signals takes to get from the mating edge to the mounting edge of the contact module. Skew is typically the result of different electrical lengths, which in turn are the result of different physical lengths of terminals. At least some known contact modules have addressed the skew problem by physically lengthening the shorter terminal of the pair of terminals carrying the differential signals. However, due to the size of the contact assemblies, it is difficult and costly to exactly match the lengths of each of the terminals. As such, skew remains a problem in many contact modules today.

There is a need for a lower cost electrical connector that addressees the skew problem with known contact modules.

BRIEF DESCRIPTION OF THE INVENTION

In one aspect, a leadframe is provided for a contact module assembly, wherein the leadframe includes a terminal set having first, second and third terminals configured to operate in one of a signal-signal-ground pattern and a ground-signal-signal pattern. Each of the terminals have a length that extends between a mating end and a mounting end, wherein a difference in the lengths between the first terminal and the second terminal is the same as a difference in the lengths between the second terminal and the third terminal such that the terminal set has the same amount of skew between the terminals defining signal contacts in both the signal-signal-ground pattern and the ground-signal-signal pattern.

Optionally, the first terminal may have a first length between the ends, the second terminal may have a second length between the ends shorter than the first length, and the third terminal may have a third length between the ends shorter than the second length. Each of the terminals may have a transition section defined between a first plane extending perpendicularly through each of the terminals in the terminal set and a second plane extending perpendicularly through each of the terminals in the terminal set. The transition section of the first terminal may have a first transition length, the transition section of the second terminal may have a second transition length that is longer than the first transition length by a first amount, and the transition section of the third terminal may have a third transition length that is longer than the second transition length by a second amount that is the same as the first amount such that the skew between the first and second terminals is reduced by the same amount as the skew between the second and third terminals within the transition section. Optionally, the terminals may have predetermined lengths along the second transition portions that create predetermined amounts of skew between adjacent ones of the terminals, wherein the first transition portions each have different lengths such that the skew between the signal terminals is reduced by an amount when the leadframe is configured in the signal-signal-ground pattern and the skew between the signal terminals is reduced by the same amount when the leadframe is configured in the ground-signal-signal pattern. Optionally, the first transition portions of the first and second terminals may reduce the skew by the same amount as the first transition portions of the second and third terminals.

In another aspect, a contact module assembly is provided that includes a leadframe having multiple terminal sets, wherein each terminal set has first, second and third terminals configured to operate in one of a signal-signal-ground pattern and a ground-signal-signal pattern. Each of the terminals have a length that extends between a mating end and a mounting end, wherein a difference in lengths between the first terminal and the second terminal is the same as a difference in lengths between the second terminal and the third terminal such that the terminal set has the same amount of skew between the terminals defining signal contacts in both the signal-signal-ground pattern and the ground-signal-signal pattern. The contact module assembly also includes a dielectric body surrounding at least a portion of the leadframe. The leadframe and dielectric body have a mating edge portion and a mounting edge portion, wherein a portion of each of the terminals is exposed from the dielectric body.

In a further aspect, a leadframe for a contact module assembly is provided, wherein the leadframe includes a plurality of terminals each having a mating contact, a mounting contact and an intermediate section extending therebetween. The intermediate section of each terminal includes a first transition portion proximate the mating contact and a second transition portion proximate the mounting contact. The second transition portions of adjacent ones of the terminals have different lengths such that a predetermined amount of skew is created between adjacent ones of the terminals. The first transition portions of adjacent ones of the terminals have different lengths selected to reduce the amount of skew between the adjacent ones of the terminals by equal amounts.

DETAILED DESCRIPTION OF THE INVENTION

Figure 1:
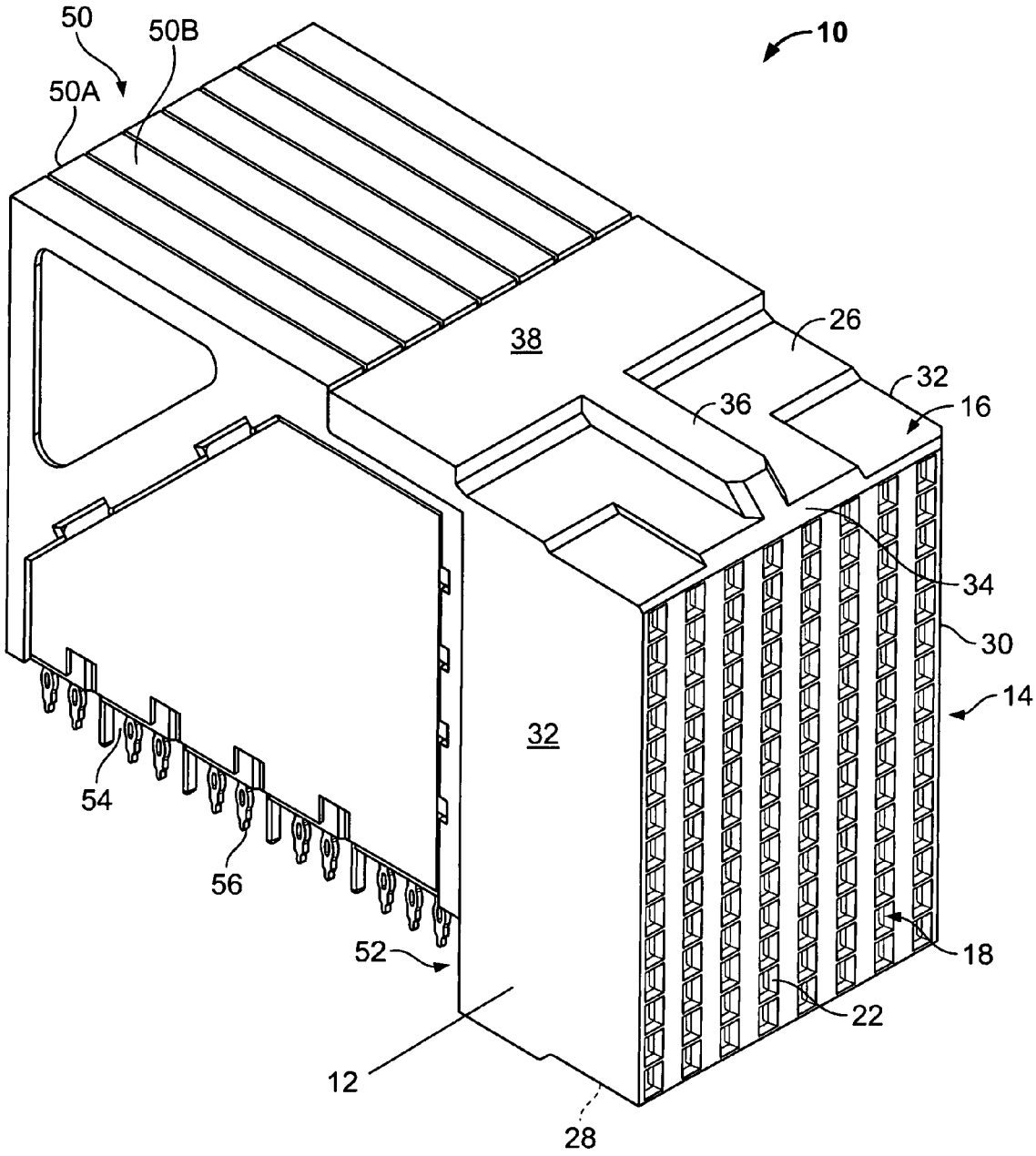
FIG. 1 is a perspective view of an exemplary embodiment of an electrical connector.

FIG. 1 illustrates an exemplary embodiment of an electrical connector 10. While the connector 10 will be described with particular reference to a receptacle connector, it is to be understood that the benefits herein described are also applicable to other connectors in alternative embodiments. The following description is therefore provided for purposes of illustration, rather than limitation, and is but one potential application of the inventive concepts herein.

The connector 10 includes a dielectric housing 12 having a forward mating end 14 that includes a shroud 16 and a mating face 18. The mating face 18 includes a plurality of mating contacts 20 (shown in FIGS. 3 and 4), such as, for example, contacts within contact cavities 22, that are configured to receive corresponding mating contacts (not shown) from a mating connector (not shown). The shroud 16 includes an upper surface 26 and a lower surface 28 between opposed sides 30, 32. The upper and lower surfaces 26 and 28, respectively, each include a chamfered forward edge portion 34. An alignment rib 36 is formed on the upper shroud surface 26 and lower shroud surface 28. The chamfered edge portion 34 and the alignment ribs 36 cooperate to bring the connector 10 into alignment with the mating connector during the mating process so that the contacts in the mating connector are received in the contact cavities 22 without damage.

The housing 12 also includes a rearwardly extending hood 38. A plurality of contact module assemblies 50 are received in the housing 12 from a rearward end 52. The contact module assemblies 50 define a connector mounting face 54. The connector mounting face 54 includes a plurality of contacts 56, such as, but not limited to, pin contacts, or more particularly, eye-of-the-needle-type contacts, that are configured to be mounted to a substrate (not shown), such as, but not limited to, a circuit board. In an exemplary embodiment, the mounting face 54 is substantially perpendicular to the mating face 18 such that the connector 10 interconnects electrical components that are substantially at a right angle to one another. In one embodiment, the housing 12 holds two or more different types of contact module assemblies 50, such as, but not limited to, contact module assemblies 50A, 50B. Alternatively, the housing 12 may hold only a single type of contact module assembly 50, such as, but not limited to, any of the contact module assemblies 50A, 50B.

Figure 2:
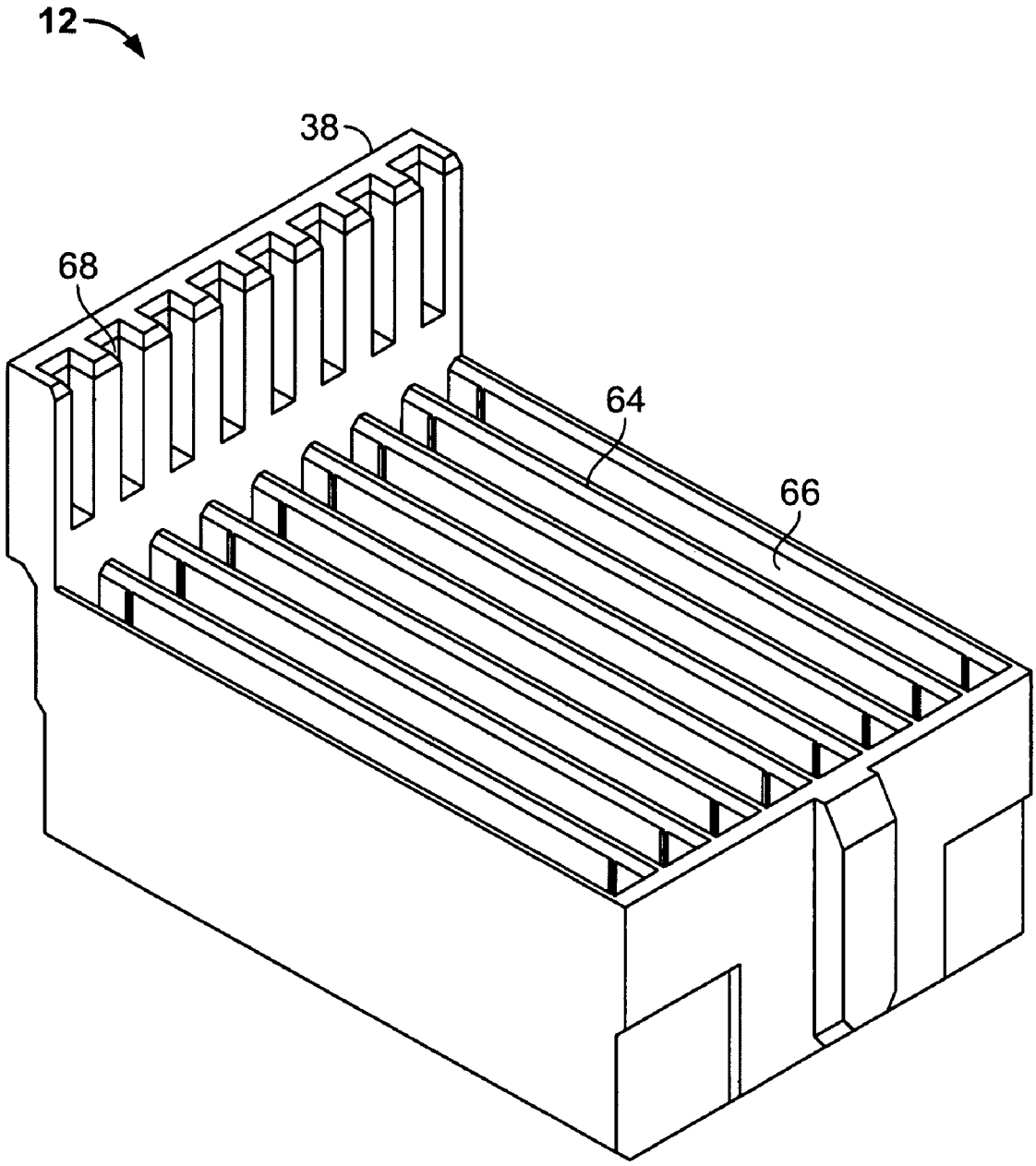
FIG. 2 is a rear perspective view of an exemplary housing of the electrical connector shown in FIG. 1.

FIG. 2 illustrates a rear perspective view of the housing 12. The housing 12 includes a plurality of dividing walls 64 that define a plurality of chambers 66. The chambers 66 receive a forward portion of the contact module assemblies 50 (FIG. 1). A plurality of slots 68 are formed in the hood 38. The chambers 66 and slots 68 cooperate to stabilize the contact module assemblies 50 when the contact module assemblies 50 are loaded into the housing 12. In an exemplary embodiment, the chambers 66 each have about an equal width and the slots 68 each have about an equal width. However, some or all of the chambers 66, and/or some or all of the slots 68, may different widths for accommodating differently sized contact module assemblies 50. The chambers 66 and slots 68 may optionally extend substantially an entire length of the contact module assemblies 50 such that the chamber walls separate adjacent contact module assemblies 50.

Figure 3:
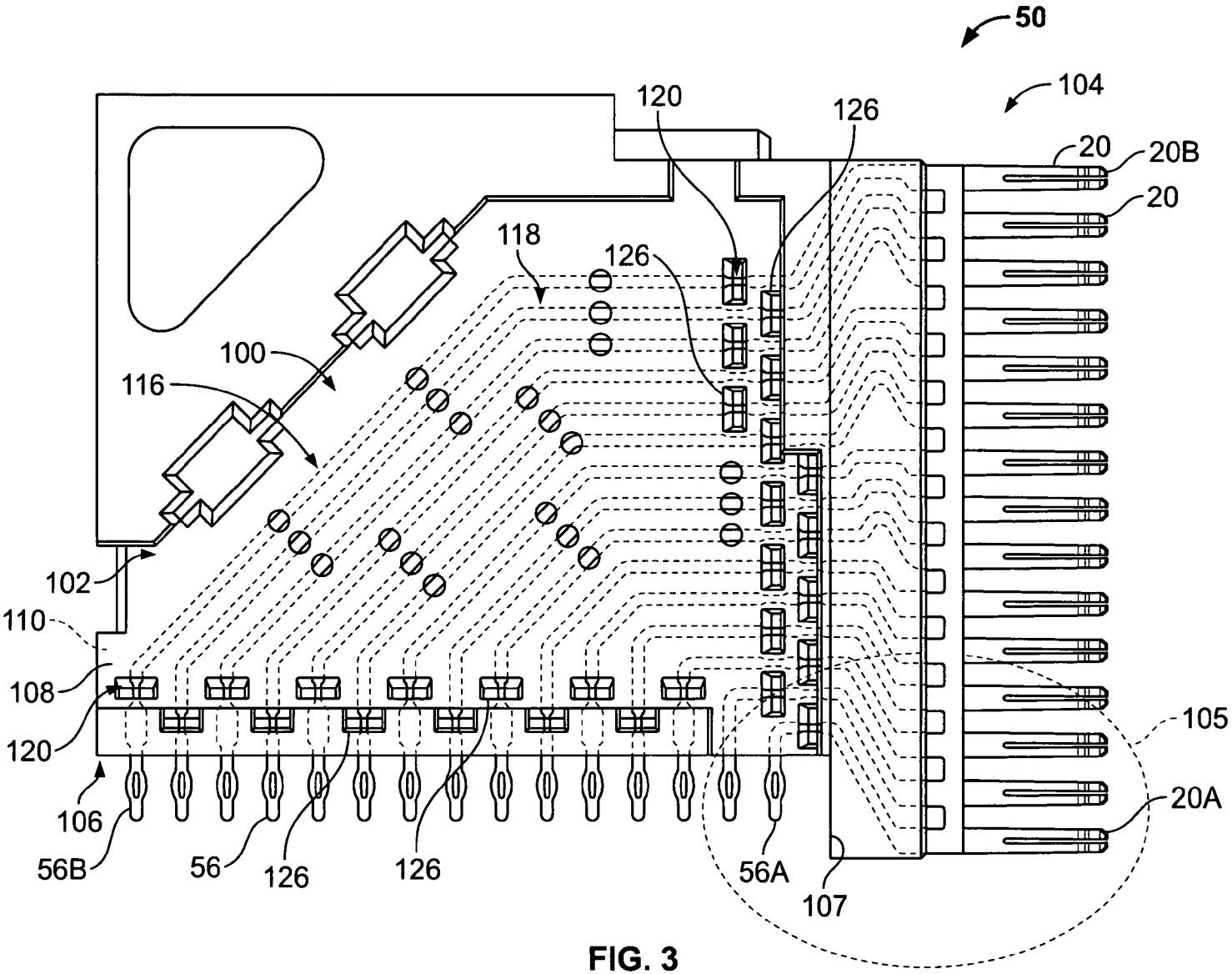
FIG. 3 is a side view of an exemplary embodiment of a contact module that may be used with the electrical connector shown in FIG. 1.
Figure 4:
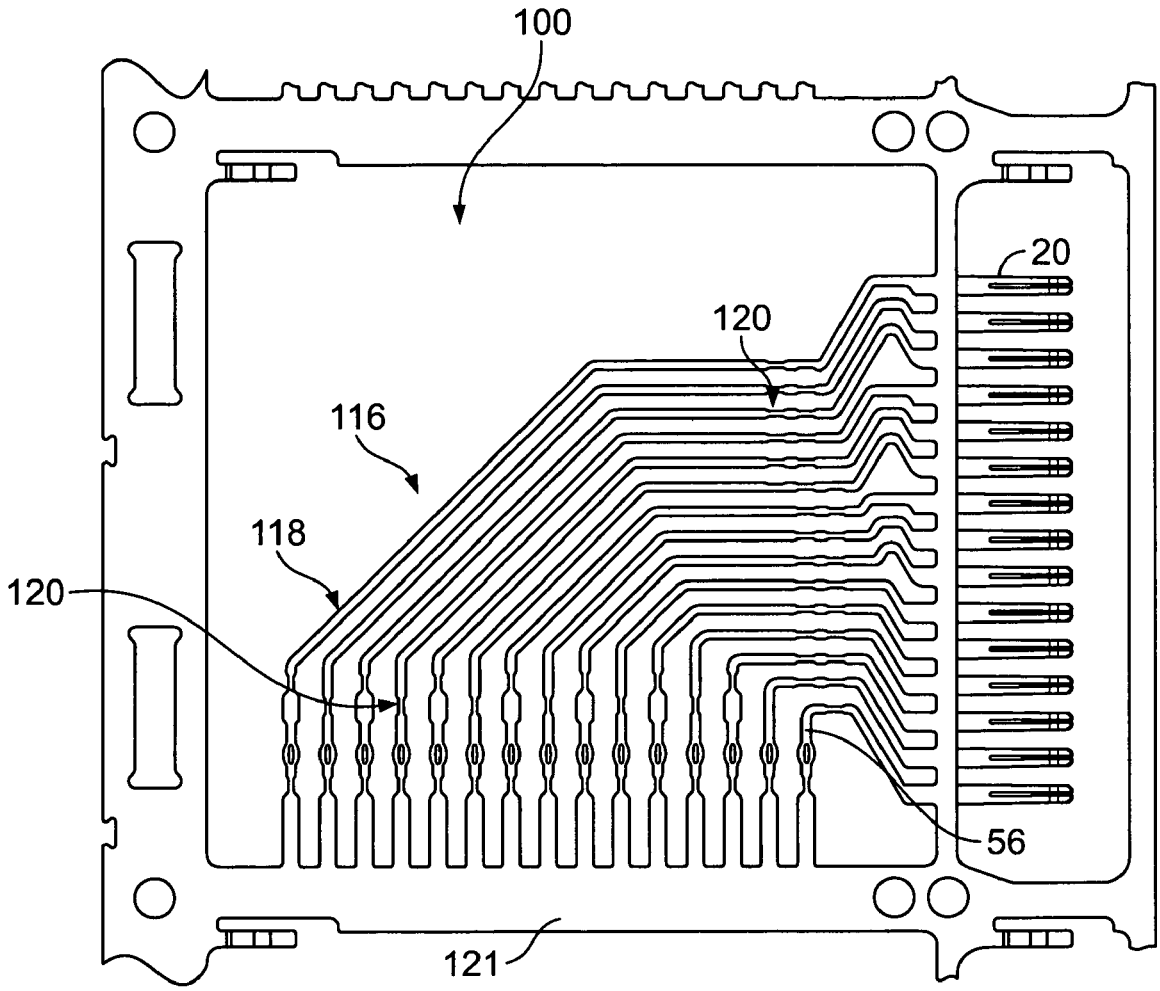
FIG. 4 is a side view of an exemplary embodiment of a leadframe for the contact module shown in FIG. 3.

FIG. 3 illustrates an exemplary embodiment of one of the contact modules 50 that includes an exemplary embodiment of an internal leadframe 100, shown in phantom outline, and a dielectric body 102. FIG. 4 illustrates the leadframe 100 that is held within the contact module 50. The leadframe 100 includes a plurality of terminals 116 enclosed within the body 102. The mating contacts 20 extend from a mating edge portion 104 of the body 102 and the leadframe 100, and the mounting contacts 56 extend from a mounting edge portion 106 of the body 102 and the leadframe 100. The mating edge portion 104 and the mounting edge portion 106 generally meet at an intersection area 105 proximate a lower-front portion of the contact module 50. In an exemplary embodiment, the mounting edge portion 106 intersects with a rearward facing end wall 107 proximate the mating edge portion 104. Alternatively, the mating edge portion 104 may intersect the mounting edge 106. The mating contacts 20 are positioned successively upward from the intersection area 105, while the mounting contacts are positioned successively rearward from the intersection area 105, however, alternative orientations are possible in alternative embodiments. In the illustrated embodiment, a mating contact 20A defines a radially inner mating contact, while a mating contact 20B defines a radially outer mating contact. Similarly, a mounting contact 56A defines a radially inner mounting contact, while a mounting contact 56B defines a radially outer mounting contact.

The body 102 includes opposite side portions 108 and 110 that extend substantially parallel to and along the leadframe 100. In some embodiments, the body 102 is manufactured using an over-molding process. During the molding process, the leadframe 100 is encased in a dielectric material, which forms the body 102. As illustrated in FIG. 4, prior to over-molding, the leadframe 100 is preferably stabilized by an integral carrier strip 121 which is removed and discarded after the over-molding process that creates the body 102. In an exemplary embodiment, the mating and mounting edge portions 104 and 106, respectively, extend substantially perpendicular to each other. However, the mating and mounting edge portions 104 and 106, respectively, may extend any direction relative to each other, such as, but not limited to, substantially parallel.

The leadframe 100 includes the plurality of terminals 116 that extend along predetermined paths to electrically connect each mating contact 20 to a corresponding mounting contact 56. The terminals 116 include the mating and mounting contacts 20 and 56, respectively, and an intermediate section 118, which extends between the mating and mounting contacts 20 and 56, respectively. In some embodiments, the intermediate section 118 extends obliquely between the mating and mounting contacts 20 and 56, respectively. For example, in an exemplary embodiment, the intermediate section 118 extends at approximately a forty-five degree angle between the mating and mounting contacts 20 and 56, respectively. The terminals 116 may be either signal terminals, ground terminals, or power terminals. The leadframe 100 may include any number of terminals 116, any number of which may be selected as signal terminals, ground terminals, or power terminals according the desired pinout selected for the contact module 50. Optionally, adjacent signal terminals may function as differential pairs, and each differential pair may be separated by a ground terminal.

In an exemplary embodiment, such as illustrated in FIGS. 3 and 4, each of the terminals 116 includes a necked-down portion 120 that may be engaged to a commoning member 124 (shown in FIG. 7), as will be described in more detail below. Optionally, select ones of the terminals 116 are engaged to the commoning member 124 to selectively interconnect those terminals 116. The dielectric body 102 includes a plurality of openings 126 that each exposes the necked-down portion 120 of a corresponding one of the terminals 116. Portions of the commoning member 124, such as tabs, may extend into the openings 126 to engage the terminals 116. Alternative configurations are possible that enable the terminals 116 to directly physically engage and electrically connect to the commoning member 124. For example, the terminals 116 may include openings therein for receiving portions of the commoning member 124.

Figure 5:
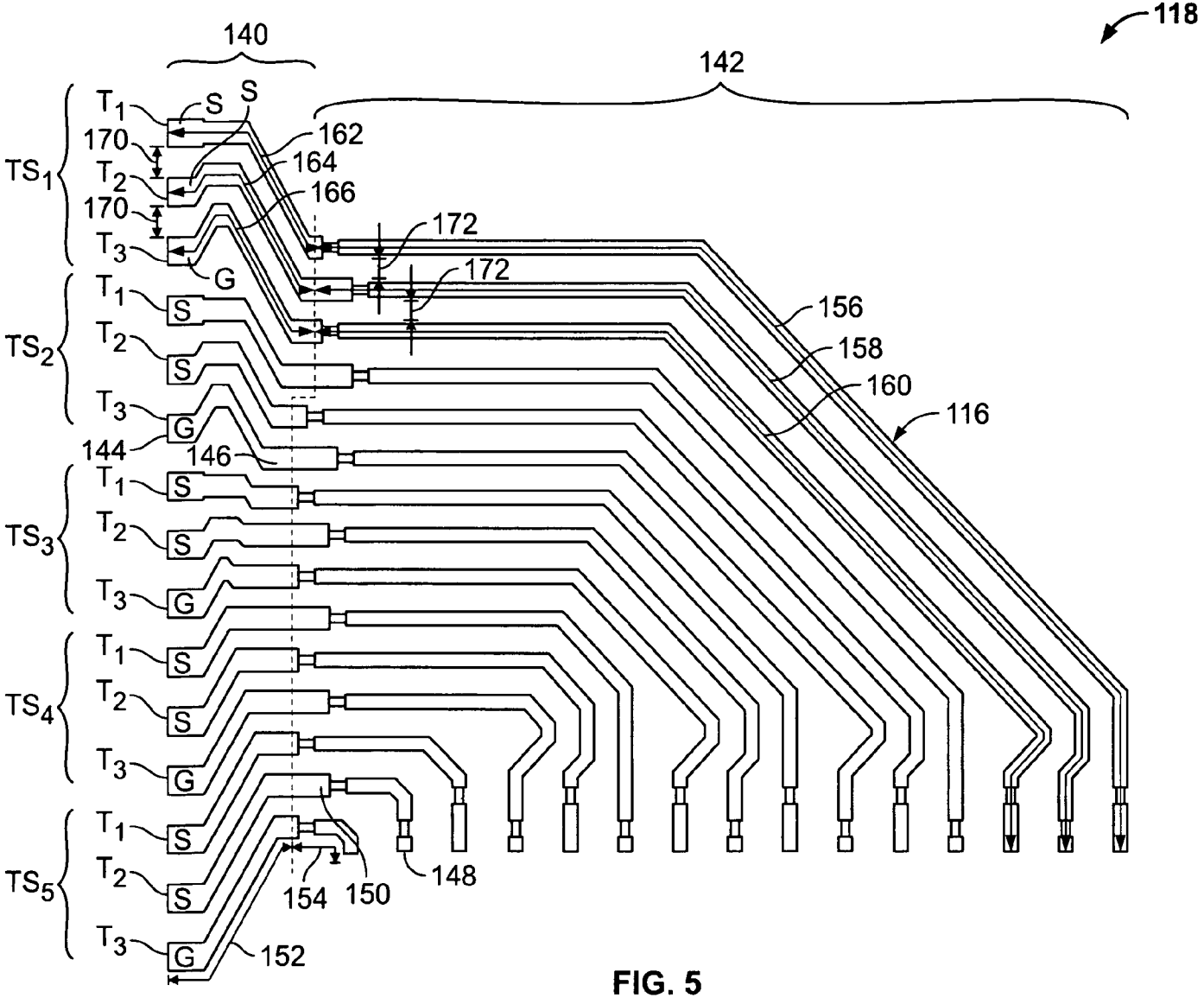
FIG. 5 is a side view of a portion of an alternative leadframe similar to the leadframe shown in FIG. 4.

FIG. 5 is a side view of an alternative leadframe 100 similar to the leadframe 100 shown in FIG. 4, and includes like elements having like reference numerals. The leadframe illustrates the intermediate sections 118 of the terminals 116. As described above, the intermediate sections 118 extend between the mating contacts 20 (shown in FIG. 4) and the mounting contacts 56 (shown in FIG. 4). The intermediate sections 118 each include a first transition section 140 and a second transition section 142. Additional transition sections may also be provided.

The first transition section 140 generally extends between the mating contact 20 and the second transition section 142. The first transition section 140 includes a mating contact end 144 and a second transition section end 146. Similarly, the second transition section 142 generally extends between the mounting contact 58 and the first transition section 140. The second transition section 140 includes a mounting contact end 148 and a first transition section end 150.

In an exemplary embodiment, the terminals 116 are arranged in terminal sets, such as the terminal sets $TS_1$-$TS_5$. The terminal sets $TS_1$-$TS_5$ each include three terminals, namely a first or outer terminal, a second or middle terminal, and a third or inner terminal, numbered $T_1$-$T_3$, respectively. Each of the terminal sets include signal terminals, ground terminals, or power terminals arranged in patterns. For example, in the illustrated embodiment, the terminal sets $TS_1$-$TS_5$ are arranged in a first pattern of ground and signal terminals. When viewed from the outer terminal $T_1$ to the inner terminal $T_3$, the terminals 116 are arranged as signal, signal and ground terminals, respectively. Such a pattern is referred to hereinafter as a signal-signal-ground pattern. Other patterns are possible in alternative embodiments. For example, the terminal sets may include more than three terminals, such as four terminals, arranged in one of a signal-signal-ground-ground, a ground-signal-signal-ground, a ground-ground-signal-signal and a ground-signal-ground-signal pattern. The terminal sets may include more terminals in alternative embodiments, and adjacent terminal sets may include different numbers of terminals therein in alternative embodiments. Optionally, only one terminal set may be provided.

Figure 6:
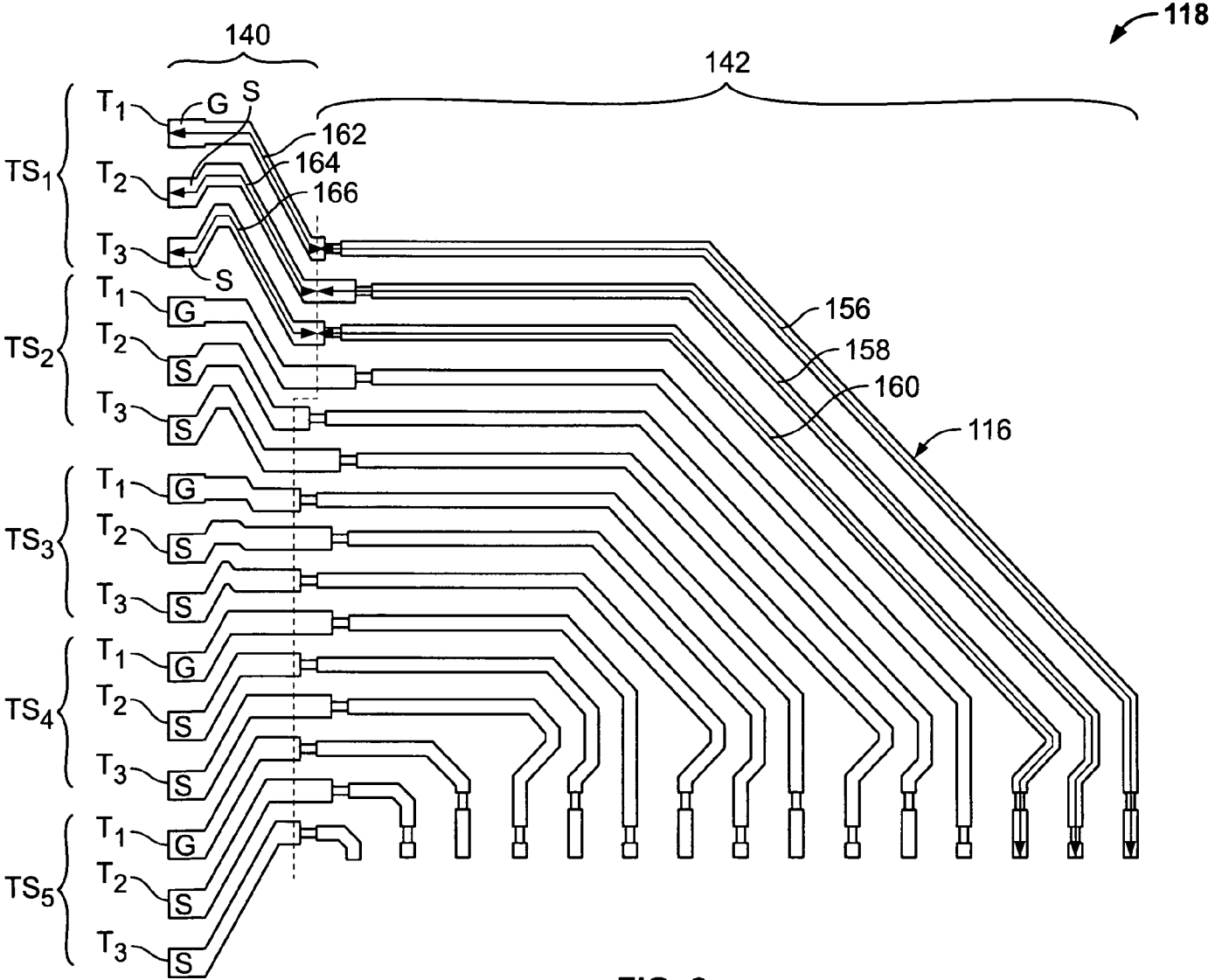
FIG. 6 is a side view of the leadframe shown in FIG. 5 having a different pattern of terminals.

FIG. 6 illustrates the same intermediate sections 118 of the leadframe 100 arranged in a second, different pattern. The terminal sets $TS_1$-$TS_5$ are arranged in a second pattern of ground and signal terminals. When viewed from the outer terminal $T_1$ to the inner terminal $T_3$, the terminals 116 are arranged as ground, signal, and signal terminals, respectively. Such a pattern is referred to hereinafter as a ground-signal-signal pattern. As shown with reference to FIGS. 5 and 6, the leadframe 100 may be used in two different pinouts when mated with contacts of mating connectors by providing multiple terminal patterns. Additionally, the terminals 116 may be arranged in more than two patterns, depending on the pinouts of the mating connectors.

Returning to FIG. 5, the terminals 116 within the terminal sets $TS_1$-$TS_5$ have different lengths. When referring to the length of the terminal 116, the length may define either the physical length of the terminal or the electrical length of the terminal. The electrical length is determined based on factors such as the physical length, the dielectric, the material of the terminal, and the like. The length relates to the amount of skew in that a signal requires more time to travel along a longer terminal than a shorter terminal. In the illustrated embodiment, referring to the physical length of the terminals 116, each of the first transition portions 140 may have a first transition length 152 and each of the second transition portions 142 may have a second transition length 154. The first transition length 152 is less than the second transition length 154. Optionally, the first transition length 152 may be substantially less than the second transition length 154. A section length of each intermediate section is the sum of the lengths 152, 154. Generally, the section lengths of inner ones of the terminal sets (e.g. ones closer to the intersection area 105) are shorter than outer ones of the terminal sets (e.g. ones further from the intersection area 105). The section lengths of terminals 116 within a given terminal set are approximately the same to reduce skew created between the terminals 116 within the terminal set. However, the section lengths may not be exactly equal due to physical size constraints of the body section 102 (shown in FIG. 3), but may be within an acceptable tolerance.

In the illustrated embodiment, referring specifically to the outermost terminal set $TS_1$, the second transition portion 142 of the outer terminal $T_1$ has a first length 156 between the ends 148, 150, the second transition portion 142 of the middle terminal $T_2$ has a second length 158 between the ends 148, 150 shorter than the first length 156, and the second transition portion 142 of the inner terminal $T_3$ has a third length 160 between the ends 148, 150 shorter than the second length 158. Optionally, the difference between the lengths 156 and 158 (outer and middle) may be approximately the same as the difference between the lengths 158 and 160 (middle and inner). The difference between the lengths 156 and 158 (between the two signal terminals within the terminal set $TS_1$) corresponds to a predetermined amount of skew potentially created within the second transition portion 142. Similarly, referring to FIG. 6, the difference between the lengths 158 and 160 (between the two signal terminals within the terminal set $TS_1$) corresponds to a predetermined amount of skew potentially created within the second transition portion 142.

The first transition portion 140 of the outer terminal $T_1$ has a first length 162 between the ends 144, 146, the first transition portion 140 of the middle terminal $T_2$ has a second length 164 between the ends 144, 146 longer than the first length 162, and the first transition portion 140 of the inner terminal $T_3$ has a third length 166 between the ends 144, 146 longer than the second length 164. As such, the inner terminal $T_3$, which has the shortest overall section length, has the longest first section portion 140 to make up for the shorter overall length. The difference between the lengths 162, 164 (between the two signal terminals within the terminal set $TS_1$) corresponds to a predetermined amount of skew potentially created within the first transition portion 140. However, the skew potentially created within the first transition portion 140 is generally opposite to, and attempts to compensate for, the skew potentially created within the second transition portion 142. As such, the total amount of skew between the signal terminals of the terminal set $TS_1$ having the signal-signal-ground pattern is reduced by lengthening the middle terminal $T_2$.

Similarly, referring to FIG. 6, the middle terminal $T_2$, which has a shorter overall section length than the outer terminal $T_1$, has a longer first section portion 140 to make up for the shorter overall section length of the middle terminal $T_2$ as compared to the outer terminal $T_1$. The difference between the lengths 164, 166 (between the two signal terminals within the terminal set $TS_1$) corresponds to a predetermined amount of skew potentially created within the first transition portion 140. However, the skew potentially created between the middle terminal $T_2$ as compared to the inner terminal $T_3$ within the first transition portion 140 is generally opposite to, and attempts to compensate for, the skew potentially created within the second transition portion 142. As such, the total amount of skew between the signal terminals of the terminal set $TS_1$ having the ground-signal-signal pattern is reduced by lengthening the inner terminal $T_3$.

In an exemplary embodiment, the lengths 162, 164 and 166 of the first transition portions 140 of the terminals 116 are selected such that the difference between the lengths 162, 164 of the outer terminal $T_1$ and the middle terminal $T_2$ are substantially the same as the difference between the lengths 164, 166 of the middle terminal $T_2$ and the inner terminal $T_3$. As such, the terminal set $TS_1$ has substantially the same amount of skew reduction created within the first transition portions 140 between the terminals 116 defining the signal contacts independent of the pinout or pattern. For example, the skew reduction created within the first transition portions 140 between the signal terminals $T_1$ and $T_2$ in the signal-signal-ground pattern is substantially the same as the skew reduction created within the first transition portions 140 between the signal terminals $T_2$ and $T_3$ in the ground-signal-signal pattern. Thus, the leadframe 100 may be used independent of the pinout and have substantially the same electrical performance and characteristics.

Optionally, the first transition portion 140 of the middle terminal $T_2$ may be longer than the first transition portion 140 of the outer terminal $T_1$ by a first amount, and the first transition portion 140 of the third terminal $T_3$ may be longer than the first transition portion 140 of the first terminal $T_1$ by a second amount that is approximately twice the first amount. The lengths 162, 164 and 166 of the first transition portions 140 of the terminals 116 may be selected such that the difference between the overall section lengths of the outer terminal $T_1$ and the middle terminal $T_2$ is approximately zero and the difference between the overall section lengths of the middle terminal $T_2$ and the inner terminal $T_3$ is approximately zero. As such, the overall skew may be substantially eliminated.

In an exemplary embodiment, the first transition portions 140 are also used to control a pitch between each of the terminals 116 within a given terminal set (e.g. $TS_1$) and/or to control the pitch between each of the terminals within all of the terminal sets (e.g. $TS_1$-$TS_5$). Again, with reference to the first terminal set $TS_1$, the mating contact ends 144 extend along a common plane extending perpendicularly with respect to the terminals 116 at the mating contact ends 144. The terminals 116 are each spaced apart from one another by a predetermined first pitch 170 at the mating contact ends 144. Similarly, the second transition portion ends 146 of each terminal 116 within a terminal set extend along a common plane extending perpendicularly with respect to the terminals 116 at the second transition portion ends 146. The terminals 116 are each spaced apart from one another by a predetermined second pitch 172 at the second transition portion ends 146. The second pitch 172 is less than the first pitch 170. Optionally, the terminals may substantially maintain the second pitch 172 along the second transition portion 142. Optionally, each of the terminals 116 within all of the terminal sets may have substantially the same first pitch 170 and/or substantially the same second pitch 172. The change in pitch may be accomplished by changing the length of the terminals 116 within the first transition portions 140.

Figure 7:
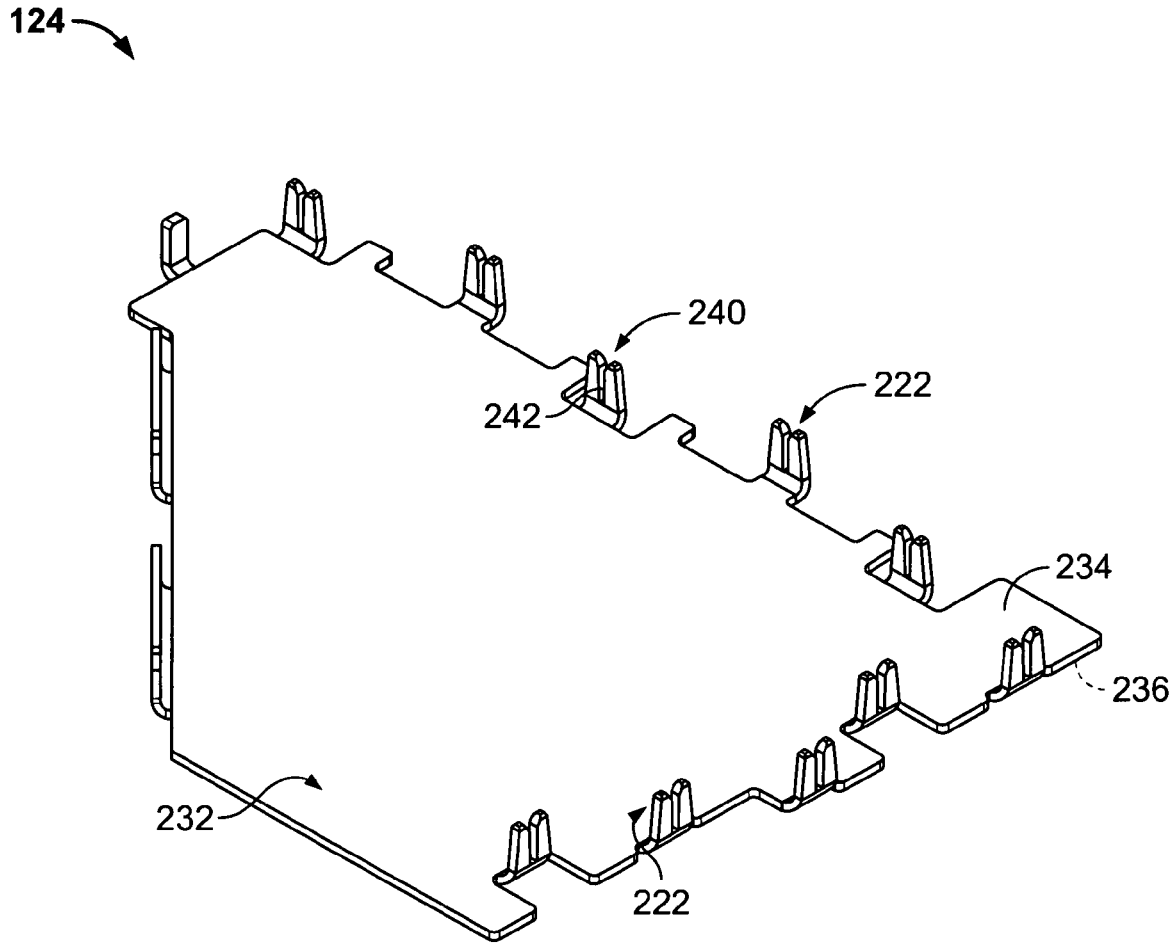
FIG. 7 is a perspective view of an exemplary embodiment of a commoning member that may be used with the contact module shown in FIG. 3.
Figure 8:
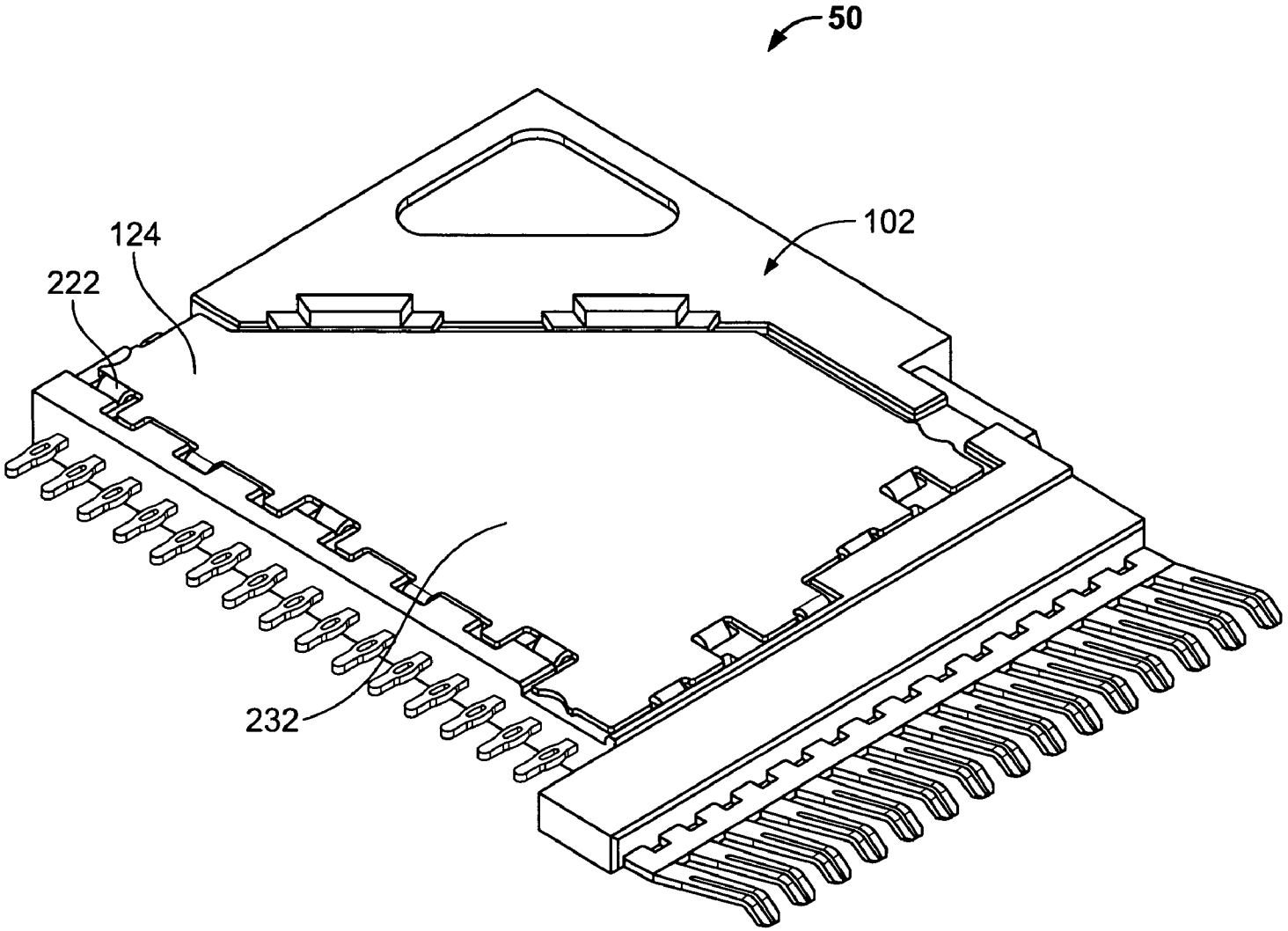
FIG. 8 is a perspective view of the commoning member shown in FIG. 7 mounted on the contact module shown in FIG. 3.

FIG. 7 is a perspective view of an exemplary embodiment of the commoning member 124. FIG. 8 is a perspective view of the commoning member 124 mounted on the contact module 50. The commoning member 124 may be fabricated in a similar manner and may be used in a similar manner as the commoning member described and illustrated in the co-pending U.S. Patent Application titled "ELECTRICAL CONNECTOR WITH PROGRAMMABLE LEAD FRAME", the disclosure of which is incorporated by reference herein.

The commoning member 124 includes a body 232 having opposite side portions 234 and 236, which extends parallel to the leadframe 100 (shown in FIG. 4) when the commoning member 124 is mounted on the contact module 50. The commoning member 124 also includes a plurality of the electrically conductive tabs 222 extending outwardly on the side portion 234. In the exemplary embodiment of FIG. 7, the tabs 222 are each insulation displacement contacts (IDCs) that include a forked portion 240 that defines an opening 242.

When the commoning member 124 is mounted on the contact module, the necked-down portion 120 (FIGS. 3 and 4) of the corresponding terminal 116 (FIGS. 3 and 4) is received within the opening 242 and engages the forked portion 240 of each tab 222 to directly physically engage and electrically connect the tab 222 to the corresponding terminal 116. However, the tabs 222 may each be any suitable type of electrical contact. The commoning member 124 may have any number of the tabs 222, and the tabs 222 may have any suitable relative arrangement and/or pattern on the commoning member 124 that configures the leadframe 100 with the desired pattern of commoned terminals 116. For example, the tabs 222 may be configured to engage all or at least a sub-set of the terminals 116 that define ground terminals, such that each of the ground terminals may be electrically commoned. Additionally, different commoning members 124 may be used, depending on the pinout pattern of the contact module 50. For example, a first commoning member 124, having a particular pattern of tabs 222, is used with a signal-signal-ground pattern and a second commoning member 124, having a different pattern of tabs 222, is used with a ground-signal-signal pattern.

The contact module and leadframe embodiments described and/or illustrated herein provide contact modules having a leadframe structure that may be selectively programmable with a plurality of different wiring patterns. Specifically, each of the leadframe terminals 116 is selectively configurable as a signal terminal, a ground terminal, or a power terminal. The leadframe 100 is designed to control the skew between adjacent signal terminals carrying differential pair signals. For example, within each terminal set (e.g. a single ground terminal and two signal terminals), the skew between adjacent ones of the terminals are controlled within the first transition portion 140 to make up for the skew created within the second transition portion 142. The lengths of the first transition portions 140 are controlled such that the amount of skew between each of the terminals within a terminal set is reduced by substantially the same amount independent of the pattern. For example, the skew between the signal contacts in the signal-signal-ground pattern is the same as the skew between the signal contacts in the ground-signal-signal pattern. Thus, the leadframe 100, by specifically controlling lengths of the terminals within the first transition portion, is adapted for compensating for intra-set skew, or skew within a given terminal set. In an exemplary embodiment, the leadframe 100, within the first transition portions, reduces the skew by an equal amount, in that the skew is reduced by substantially the same amount within an acceptable tolerance. The leadframe 100 may be used independent of the pinout and has the same electrical performance and characteristics within different pinouts. Optionally, commoning members 124 may be used to interconnect certain ones of the terminals 116 depending on the pattern.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A leadframe for a contact module assembly, the leadframe comprising:

a terminal set having first, second and third terminals configured to operate in one of a signal-signal-ground pattern and a ground-signal-signal pattern, each of the terminals have a length that extends between a mating end and a mounting end, wherein a difference in the lengths between the first terminal and the second terminal is the same as a difference in the lengths between the second terminal and the third terminal such that the terminal set has the same amount of skew between the terminals defining signal contacts in both the signal-signal-ground pattern and the ground-signal-signal pattern.

2. The leadframe of claim 1, wherein the first terminal has a first length between the ends, the second terminal has a second length between the ends shorter than the first length, and the third terminal has a third length between the ends shorter than the second length.

3. The leadframe of claim 2, wherein each of the terminals have a transition section defined between a first plane extending perpendicularly through each of the terminals in the terminal set and a second plane extending perpendicularly through each of the terminals in the terminal set, wherein the transition section of the first terminal has a first transition length, the transition section of the second terminal has a second transition length that is longer than the first transition length by a first amount, and the transition section of the third terminal has a third transition length that is longer than the second transition length by a second amount that is the same as the first amount such that the skew between the first and second terminals is reduced by the same amount as the skew between the second and third terminals within the transition section.

4. The leadframe of claim 1, wherein each of the terminals includes a first transition portion and a second transition portion, the terminals have predetermined lengths along the second transition portions that create predetermined amounts of skew between adjacent ones of the terminals, wherein the first transition portions each have different lengths such that the skew between the signal terminals is reduced by an amount when the leadframe is configured in the signal-signal-ground pattern and the skew between the signal terminals is reduced by the same amount when the leadframe is configured in the ground-signal-signal pattern.

5. The leadframe of claim 1, wherein each of the first, second and third terminals includes a first transition portion and a second transition portion, wherein the second transition portions have respectively shorter lengths, wherein the first transition portion of the second terminal is longer than the first transition portion of the first terminal by a first amount, and wherein the first transition portion of the third terminal is longer than the first transition portion of the first terminal by a second amount that is approximately twice the first amount.

6. The leadframe of claim 1, wherein each of the first, second and third terminals includes a first transition portion and a second transition portion, wherein the second transition portions have respectively shorter lengths, and wherein the first transition portions of the first and second terminals reduce the skew by the same amount as the first transition portions of the second and third terminals.

7. The leadframe of claim 1, wherein each of the terminals includes a first transition portion and a second transition portion, wherein the first transition portion of each terminal includes a mating contact end and a second transition portion end, the mating contact ends of adjacent ones of the terminals are arranged generally parallel to one another and are spaced apart from one another by a first pitch and the second transition portion ends of adjacent ones of the terminals are arranged generally parallel to one another and are spaced apart from one another by a second pitch that is less than the first pitch.

8. The leadframe of claim 1, further comprising a mating contact extending from the mating end and a mounting contact extending from the mounting end, wherein the mating and mounting contacts are non-parallel to one another.

9. A contact module assembly comprising:

a leadframe having multiple terminal sets, wherein each terminal set has first, second and third terminals configured to operate in one of a signal-signal-ground pattern and a ground-signal-signal pattern, each of the terminals have a length that extends between a mating end and a mounting end, wherein a difference in the lengths between the first terminal and the second terminal is the same as a difference in the lengths between the second terminal and the third terminal such that the terminal set has the same amount of skew between the terminals defining signal contacts in both the signal-signal-ground pattern and the ground-signal-signal pattern, and a dielectric body surrounding at least a portion of the leadframe, the leadframe and the dielectric body having a mating edge portion and a mounting edge portion, wherein a portion of each of the terminals is exposed from the dielectric body.

10. The contact module assembly of claim 9, wherein the first terminal has a first length between the ends, the second terminal has a second length between the ends shorter than the first length, and the third terminal has a third length between the ends shorter than the second length.

11. The contact module assembly of claim 9, wherein each of the terminals have a transition section defined between a first plane extending perpendicularly through each of the terminals in the terminal set and a second plane extending perpendicularly through each of the terminals in the terminal set wherein the transition section of the first terminal has a first transition length, the second terminal has a second transition length that is longer than the first transition length by a first amount, and the third terminal has a third transition length that is longer than the second transition length by a second amount that is the same as the first amount such that the skew between the first and second terminals is reduced by the same amount as the skew between the second and third terminals within the transition section.

12. A leadframe for a contact module assembly, the leadframe comprising:

a plurality of terminals each having a mating contact, a mounting contact and an intermediate section extending therebetween, the intermediate section of each terminal includes a first transition portion proximate the mating contact and a second transition portion proximate the mounting contact, wherein the second transition portions of adjacent ones of the terminals have different lengths such that a predetermined amount of skew is created between adjacent ones of the terminals, and wherein the first transition portions of adjacent ones of the terminals have different lengths selected to reduce the amount of skew between the adjacent ones of the terminals by equal amounts.

13. The leadframe of claim 12, wherein the plurality of terminals includes a terminal set having a ground terminal and two signal carrying differential pair signals, the terminals within the terminal set being configurable into a first pattern of ground and signal terminals and a second pattern of ground and signal terminals that is different from the first pattern such that the leadframe is selectively programmable with either one of the first and second patterns.

14. The leadframe of claim 12, wherein the plurality of terminals includes a terminal set having a ground terminal and two signal terminals carrying differential pair signals, the terminals within the terminal set being configurable into a first pattern of ground and signal terminals and a second pattern of ground and signal terminals that is different from the first pattern, and wherein the skew between the signal contacts is reduced within the first transition portions by the same amount in the first pattern and in the second pattern.

15. The leadframe of claim 12, wherein the plurality of terminals includes a terminal set having first, second and third terminals having second transition portions with respectively shorter lengths, wherein the first transition portion of the second terminal is longer than the first transition portion of the first terminal by a first amount, and wherein the first transition portion of the third terminal is longer than the first transition portion of the first terminal by a second amount that is approximately twice the first amount.

16. The leadframe of claim 12, wherein the plurality of terminals includes a terminal set having first, second and third terminals having second transition portions with respectively shorter lengths, wherein the first transition portions of the first and second terminals reduce the skew by the same amount as the first transition portions of the second and third terminals.

17. The leadframe of claim 12, wherein the first transition portion of each terminal includes a mating contact end and a second transition portion end, the ends of adjacent ones of the terminals are arranged generally parallel to one another and spaced apart from one another by a predetermined pitch, wherein the pitch at the mating contact end is larger than the pitch at the second transition portion end.

18. The leadframe of claim 17, wherein the pitch at the mating contact end is the same for each of the terminals, and wherein the pitch at the second transition portion end is the same for each of the terminals.

19. The leadframe of claim 12, further comprising a commoning member configured to be directly electrically connected to corresponding ones of the terminals within the terminal sets such that electrical connection between the commoning member and the corresponding terminals configures the leadframe with a predetermined grounding pattern.

20. The leadframe of claim 12, further comprising a dielectric body surrounding at least a portion of the terminals, the dielectric body having a mating edge portion and a mounting edge portion that are non-parallel with one another.

* * * * *